United States Patent [19]

Troope et al.

[11] 3,940,833

[45] Mar. 2, 1976

[54] METHOD FOR COMPRESSIVELY SHRINKING TEXTILE FABRICS AT HIGH SPEED

[75] Inventors: Walter S. Troope, Latham; Jackson Lawrence, Troy, both of N.Y.

[73] Assignee: Cluett, Peabody & Co., Inc., Troy, N.Y.

[22] Filed: Apr. 26, 1973

[21] Appl. No.: 354,708

[52] U.S. Cl. ..... 26/18.6

[51] Int. Cl.[2] ..... D06C 21/00

[58] Field of Search ..... 26/18.6; 38/11, 68; 162/111, 280, 361

[56] References Cited

UNITED STATES PATENTS

| | | | |
|---|---|---|---|
| 2,209,205 | 7/1940 | Neville | 26/18.6 X |
| 2,721,370 | 10/1955 | Cluett et al. | 26/18.6 |
| 2,885,763 | 5/1959 | Schreiner | 26/18.6 |
| 2,979,131 | 4/1961 | Bentov | 26/18.6 UX |
| 3,166,824 | 1/1965 | Fuhr | 26/18.6 X |
| 3,382,552 | 5/1968 | Davis et al. | 26/18.6 |
| 3,382,553 | 5/1968 | Davis et al. | 26/18.6 |
| 3,431,608 | 3/1969 | Reiners | 26/18.6 |
| 3,596,332 | 8/1971 | Winberg | 26/18.6 |
| 3,691,600 | 9/1972 | Joy | 26/18.6 |

FOREIGN PATENTS OR APPLICATIONS

| | | | |
|---|---|---|---|
| 913,194 | 12/1962 | United Kingdom | 26/18.6 |
| 125,536 | 2/1959 | Somalia | 26/18.6 |

*Primary Examiner*—Robert R. Mackey

[57] ABSTRACT

This disclosure teaches a method of longitudinally compressively shrinking a textile fabric web with the method comprising known steps of preconditioning the web, continuously feeding the web between a thick elastomeric belt and a heated polished cylinder having a low frictional resistance and thereafter drying the web. The method of this invention is characterized by selectively varying tension of the belt as well as selectively manually varying contact pressure between the belt and the polished cylinder. According to this invention skipping at high speeds is avoided and there is control of the pressure of the belt on the cylinder over a greater arc than by prior art methods.

1 Claim, 4 Drawing Figures

A
A
4
5
6
7
8
9
10
11
12
13
13a
13b
13c
14
15
16
17
18
19
19a
20
20a
20b
21a
21b
23
24
25
26
30
40
41
42
43
44
45
46
47
48
49
50
51
52
53
54
55
56
57

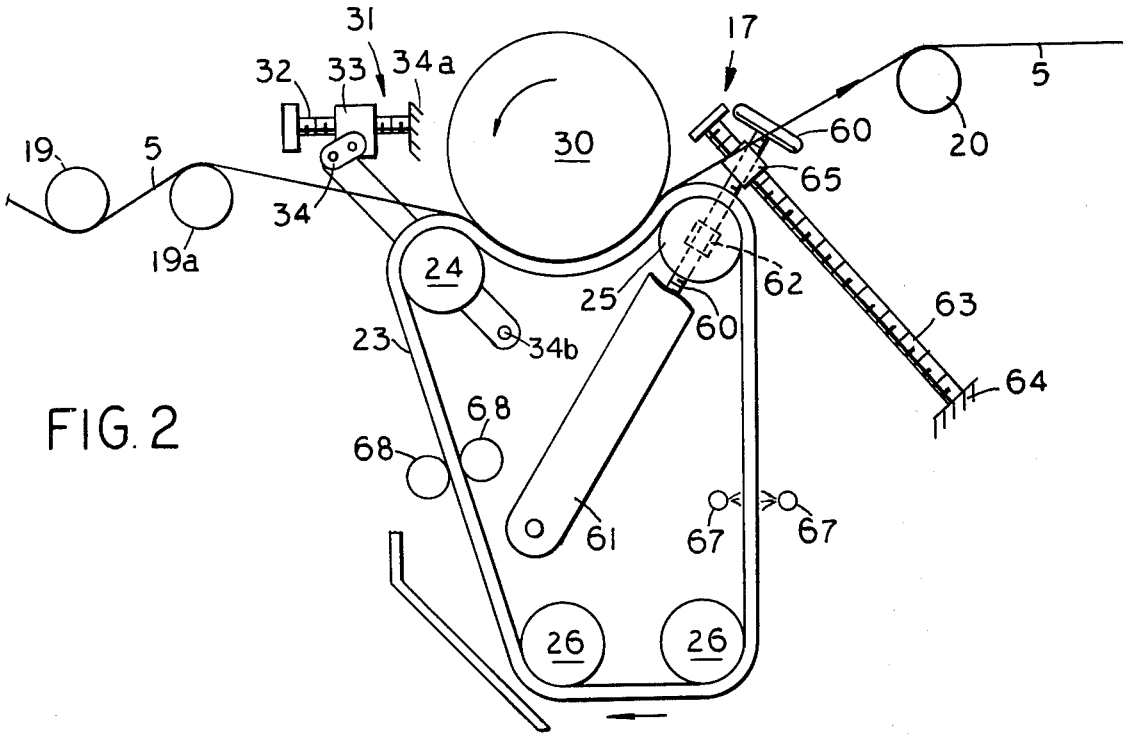
FIG. 2
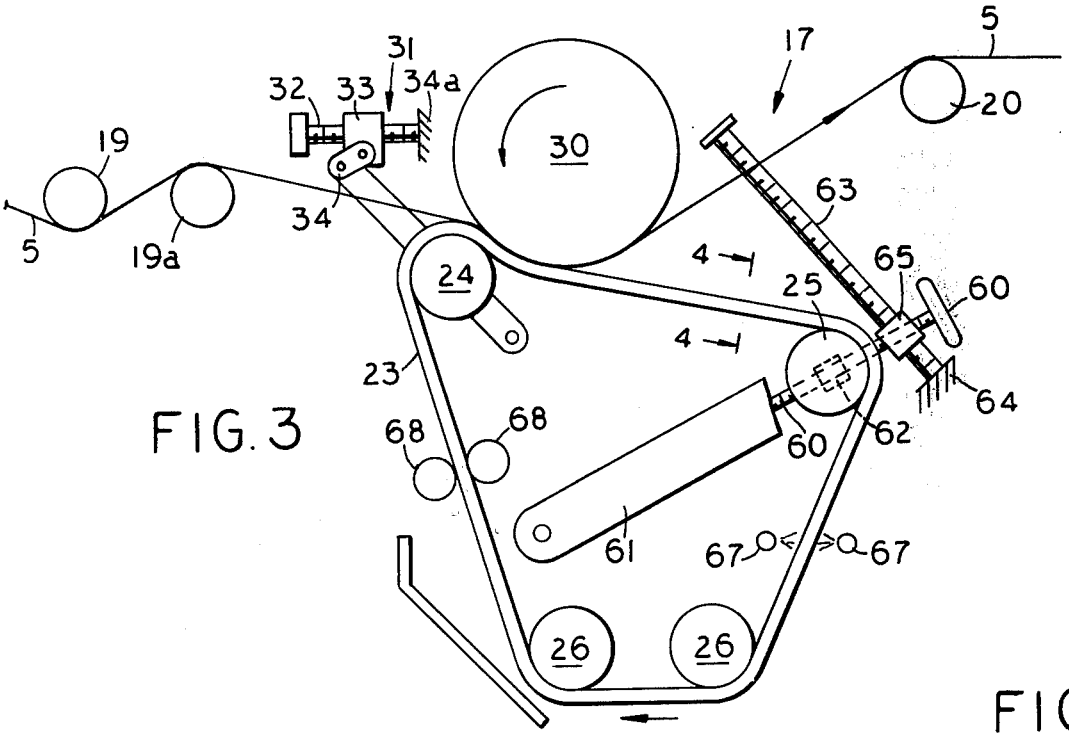
FIG. 3
FIG. 4
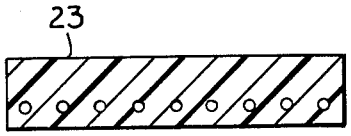

METHOD FOR COMPRESSIVELY SHRINKING TEXTILE FABRICS AT HIGH SPEED

BACKGROUND OF THE INVENTION

This invention relates generally to new and useful improvements in compressive shrinking of fabrics and particularly seeks to provide a novel method for high speed compressive shrinking employing a selectively variable wrap device in conjunction with a rubber belt unit.

Methods and machines for accomplishing compressive shrinking have been developed extensively and are exemplified in U.S. Pat. Nos. 2,021,975 and 2,146,694 where essentially the same action takes place wherein the constraining belt is of thick rubber and the moisture imparted by a water spray device is prevented from escaping during the shrinking action and the maximum speed is around 110 yards per minute and light fabrics and 40–45 yards per minute on heavier fabrics.

There are problems which develop as a result of trying to operate the apparatus of the prior art above speeds of 110 yards per minute, one of the most serious problems being skips or belt vibrations due to the centrifugal force which is created by the mass of the belt following a curved path. When these vibrations occur, they cause the rubber belt to lose contact with the heated drum and those sections of the fabric in that area are not compressively shrunk to the same degree as the balance of the fabric.

It is the purpose of the present invention to obviate the foregoing difficulties previously encountered in operating compressive shrinking apparatus of the prior art at high speeds.

SUMMARY OF THE INVENTION

In accordance with the present invention, an apparatus for longitudinally compressively shrinking a web of textile fabric is disclosed which includes a heated, hard surface cylinder having a low frictional resistance when brought into close contact with the web, a plurality of rolls each rotatable about an axis parallel to the axis of the cylinder and a rubber belt mounted on the rolls with at least one of the rolls being a driven cylinder and one of the rolls being a nip roll. Means are provided for moving a nip roll toward and away from the cylinder to form a variable nip between the belt and the cylinder. Another of the aforesaid rolls is a belt tension roll positioned adjacent to the nip roll and the cylinder, the belt traversing the tension roll after traversing the nip roll, the tension roll causing a portion of the belt intermediate the nip roll and tension roll to wrap around the cylinder. Means are provided for moving the tension roll generally tangentially to the cylinder to increase and decrease the length of contact with the drum as well as the tension of the belt. In cooperation with the foregoing apparatus, the present invention more specifically provides means for mounting the tension roll for movement generally perpendicular to the tangential direction toward and away from the cylinder to regulate the amount of wrap contact between the belt and cylinder after the belt leaves the nip and traverses the tension roll, which thereby causes the tension roll to function as a variable tension and wrap roll.

The advantages obtained for practicing the present invention are that textile fabric materials may be compressively shrunk at high speeds without skips due to belt vibration; and total production of preshrunk fabric may be greatly increased per unit of apparatus.

The apparatus and method of the invention will be more fully understood by making reference to the following detailed description of a particular embodiment and the accompanying drawings.

BRIEF DESCRIPTION OF THE DRAWINGS

FIG. 2 is an enlarged view of a section of the improved apparatus to permit the practice of the present invention with the belt shown in maximum wrap position;

FIG. 3 is an enlarged view similar to FIG. 2 showing the belt in minimum wrap position; and FIG. 4 is a section taken along line 4—4 of FIG. 3 of one type of belt useful in the practice of this invention.

DESCRIPTION OF A PARTICULAR EMBODIMENT

Figure 1:
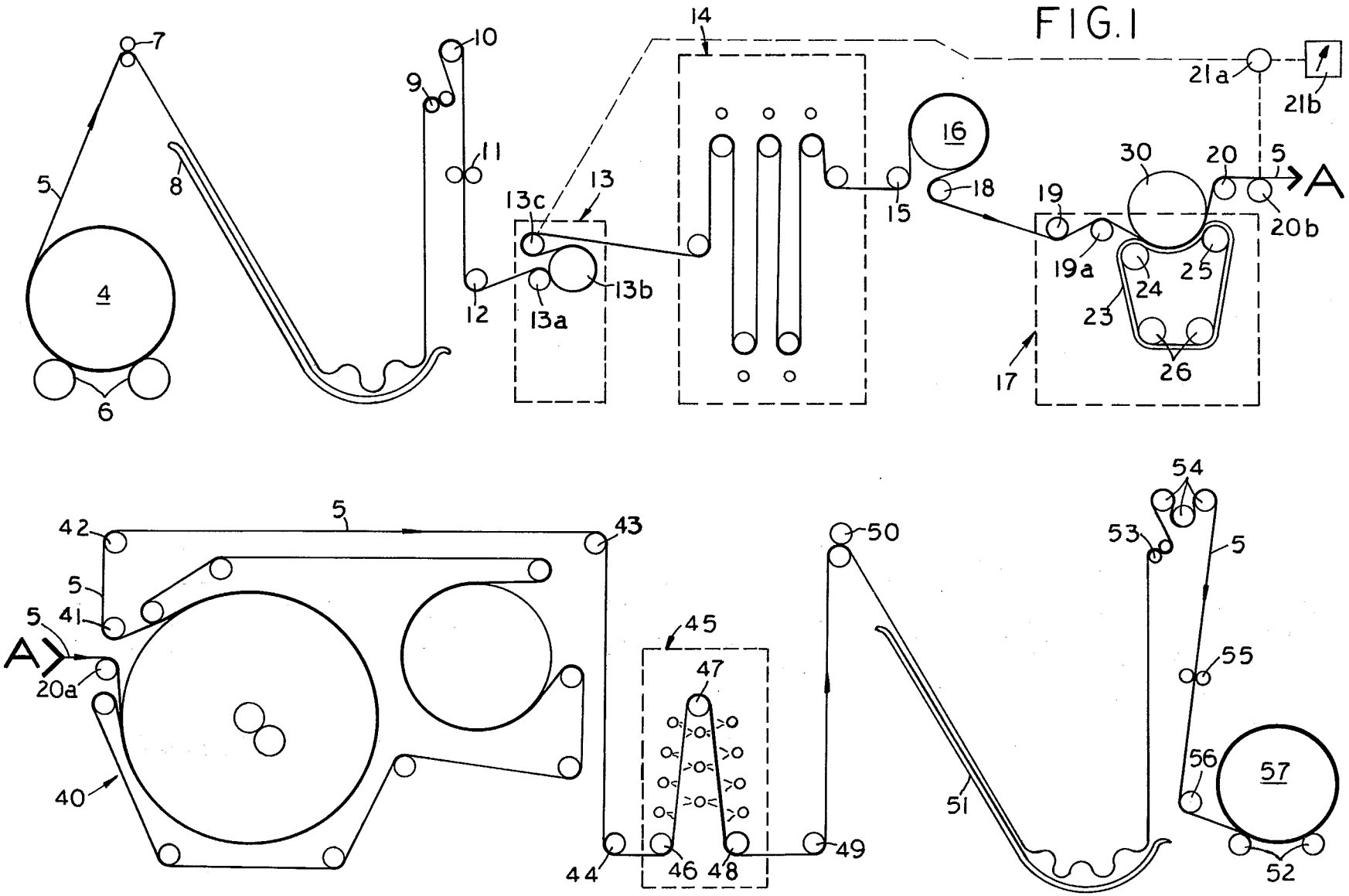
FIG. 1 diagrammatically illustrates a side elevation of one form of apparatus suitable for practicing the method of this invention.

Referring to FIG. 1 of the drawings, in detail, it will be seen that a continuous web 5 of a textile fabric is fed from fabric roll 4 by rolls 6 to a pair of scray feed rolls 7. The fabric then follows the scray chute 8, in which the material is overfed to provide storage of fabric before it is drawn from the scray through a pair of swivel tension bars 9 over a sky roll 10, downwardly through an automatic fabric guider 11 and around an idler roll 12 by a feed roll assembly 13 which includes rolls 13*a*, 13*b* and input measuring roll 13*c*. The fabric passes over the input measuring roll 13*c* through a conditioning chamber 14 wherein both faces of the web are exposed to moisture such as steam. The web 5 then passes over a weft straightening device 15 prior to contacting one or more heated dry cans 16 which serve to evenly distribute the moisture through the fibers of the web 5. Upon leaving the dry can 16, the web enters the rubber belt compressive shrinking unit (generally designated) 17 after passing over rolls 18 and 19 and a scrimp bar 19*a*. The web 5, after leaving the shrinking unit 17, passes over a stripper roll 20 and an entering roll 20*a* and into the felt belt drying unit 40. Output measuring roll 20*b* in conjunction with the input measuring roll 13*c* are interconnected electrically by tachometer generators 21*a* and to a visual metering device 21*b* whereby an operator may make any web feed adjustments necessary to indicate that the proper amount of compressive shrinkage and pull-out is taking place to insure that the web 5 is properly treated prior to discharge from the treatment range. This system of tachometer generators and related devices are disclosed in U.S. Pat. No. 2,885,763. It should additionally be mentioned that before textile fabric web 5 is subjected to compressive shrinking, a test sample thereof having marked length measurements, is laundered, dried and measured to determine the total shrinkage that has occurred in the textile fabric and thus indicate the amount of compressive shrinking that must be applied.

The fabric web 5 leaves the felt belt dryer and passes over rollers 41, 42 and 43 before being engaged by cooler entry roller 44. The web 5 passes through the air cooling unit 45 over rollers 46, 47 and 48, and around roller 49 and into scray feed rolls 50 before entering and being stored tensionless in scray chute 51. There is a batcher 52 which serves to rewind the web on a roll following drying, cooling and storage in the scray chute 51. The web is drawn over swivel tension rolls 53 and sky rolls 54 through automatic fabric guiders 55 around roll 56 and is wound on a roll 57 by the batcher mechanism. Batcher 52 is equipped with a constant torque winding apparatus and is common in equipment of this type. This results in winding of the web on the roll 57 with controlled tension.

It will be understood that the apparatus disclosed and described in connection with FIG. 1 is an assembly of known components. The improvement provided by the present invention will now be described in more detail in connection with FIG. 2 and FIG. 3.

Referring to FIG. 2, there is a large diameter highly polished heated drum 30 and relatively thick rubber belt 23 that passes beneath drum 30 and around nip roll 24, adjustable tension and wrap roll 25 and rolls 26 all of which are relatively small diameter rolls. A variable adjustment mechanism (generally designated) 31 is provided to increase or decrease the distance between nip roll 24 and the heated drum 30 thereby creating greater or less distance between roll 24 and drum 30. Adjustment mechanism 31 includes a pair of screws 32 manually rotatable to effect translation thereon of internally threaded yokes 33. Yokes 33 are connected to the ends of mounting bars 34 which include means for journalling the nip roll 24. The other ends of bars 34 are pivotally mounted to structure at 346 so that translation of yokes 33 will cause movement of nip roll 24 toward and away from drum 30.

The coaction of elements illustrated longitudinally compresses or shrinks the web in a known manner by the action of the belt as the surface portion thereof functionally bonded to the web changes from an elongated condition under tension around nip roll 24 to a compacted condition under compression around drum 30. Nip roll 24 is mounted considerably below the horizontal center line of drum 30 and is urged selectively toward and away from drum 30 by actuation of interconnection mechanism 31.

Tension and wrap roll 25 in its maximum wrap position is situated between the horizontal center line of roll 24 and drum 30 and considerably below the horizontal center line of nip roll 24 in its minimum wrap position by virtue of the adjustment elements 60 through 65. Referring now to FIG. 3 there is a belt tensioning screw 60 rotationally connected at one end to a lever 61 and to the axis bearing (not shown) of belt tension and wrap roll 25 through an internally threaded journal 62. There is also a wrap roll screw 63 rotationally connected at one end to the machine frame 64 and also slidably connected to a journal 65, which in turn is also internally threaded, to wrap roll screw 63. The turning of wrap roll screw 63 through journal 65 and tensioning screw 60 which slidably stands through journal 65 and is rotationally mounted to lever 61 causes the wrap roll 25 to raise or lower, depending on the rotation of wrap roll screw 63, through an arcuate path to increase or decrease the amount of wrap of belt 23 around cylinder 30. This arcuate adjustment and the attendant varying wrap of belt 23 against the outer periphery of roll 30 is an important advance in respect of this type of compressive shrinking machinery. The adjustment of roll 25 to increase or decrease belt wrap is arcuate and as such, does not change the tension in belt 23. If additional tension or less tension is desired in belt 23, actuation is effected through rotation of belt tensioning screw 60. There are water spray devices 67 which coat the inner and outer faces of the rubber belt to effect cooling of the belt and water removal rolls 68 to remove water or moisture from the belt 23 as it approaches the nip roll 24.

In accordance with the invention and the foregoing description, the roll 25 is made variable in its tension and wrap functions. Heretofore, variable tension rolls existed; however, to combine the functions of tension and wrap in varying degrees in the same roll is novel. The wrap of the belt about the drum 30 can be increased for slower speed operation, or can be decreased for higher speed operation without changing the tension already being applied by the roll 25. Thus it is possible to greatly increase the speed of the compacting apparatus without the harmful effects such as belt skip or vibration previously encountered by merely adjusting the tensioning screw 60 to decrease the amount of wrap about the cyliner 30.

A belt such as 23 in previous or conventional rubber belt compressive shrinking apparatus has been approximately 2¼ inches in thickness and between shore durometor hardness of 35 to 40. In accordance with the present invention it has been found that belt 23 may advantageously have a thickness of only a maximum of one inch which lesser thickness produces highly satisfactory and efficient operation at the speeds employed in the present apparatus, i.e., wherein the speed of the belt's elastomeric surface is from 110 yards per minute (minimum) and 250 yards per minute (maximum). It has also been found advantageous to mold longitudinal, horizontal equally spaced cords or threads within the belt 23 closely adjacent to the rear face thereof. By inclusion of these cords or threads within the belt there is a shift in the neutral axis of the belt. The neutral axis of the belt may be defined as that line intermediate the top and bottom surfaces which remains unaffected by bending or curvature of the belt away from the heated drum. This results in enabling the use of a thinner belt because with the neutral axis relocated in a direction away from the heated drum and the back face being restrained against extension or compression the belt surface in contact with the heated drum is forced to stretch appreciably more than if the same thickness belt was used without these cords or threads.

Although the method so far described provides for moistening or conditioning the fabric prior to compressive shrinking, it will be understood that certain lightweight fabrics would not need such pretreatment and the conditioning chamber 14 will be bypassed.

Although the present invention has been described with reference to specific apparatus, it will be appreciated by a person skilled in the art that a wide variety of changes may be made without departing from the scope of the invention. For instance, certain features of the apparatus may be used independently of others and equivalents may be substituted for apparatus elements, all within the spirit and scope of the invention as defined in the appended claims.

We claim:

1. A method for longitudinally compressively shrinking a light weight textile fabric web at high speed; the method comprising:

preconditioning the web, providing a nip roller and a take up roller adapted to pass a thick endless elastomeric belt into contact with a heated polished cylinder having a low frictional resistance, feeding continuously the web over the nip roller and between the elastomeric belt and the cylinder, selectively varying tension on the belt by adjusting positioning of the nip roller substantially tangentially relative to the cylinder, selectively varying contact pressure of the belt on the cylinder by adjusting the positioning of the take up roller; the method characterized by:

the selective varying of contact pressure achieved by arcuately biasing the take up roller radially relative to the cylinder about a fixed pivot axis for the take up roller and by biasing the take-up roller tangentially relative to the cylinder along a plane which intersects the pivot axis, varying the contact pressure inversely relative to the speed of feeding; whereby skipping of the belt at the high speed is eliminated and control of the pressure of the belt onto the cylinder over a greater arc is achieved.

* * * * *